US009791236B2

(12) United States Patent
Lee

(10) Patent No.: US 9,791,236 B2
(45) Date of Patent: Oct. 17, 2017

(54) PNEUMATIC TOY GUN RECOIL DEVICE

(71) Applicant: Tsung-Ming Lee, Taipei (TW)

(72) Inventor: Tsung-Ming Lee, Taipei (TW)

(73) Assignee: Tsung-Ming Lee, Taipei (TW)

( * ) Notice: Subject to any disclaimer, the term of this patent is extended or adjusted under 35 U.S.C. 154(b) by 397 days.

(21) Appl. No.: 14/690,378

(22) Filed: Apr. 18, 2015

(65) Prior Publication Data

US 2015/0308783 A1 Oct. 29, 2015

(30) Foreign Application Priority Data

Apr. 25, 2014 (TW) ..... 103207216 U

(51) Int. Cl.
*F41B 11/642* (2013.01)
*F41A 33/06* (2006.01)
*F41B 11/89* (2013.01)

(52) U.S. Cl.
CPC ..... *F41B 11/642* (2013.01); *F41A 33/06* (2013.01); *F41B 11/89* (2013.01)

(58) Field of Classification Search
CPC ..... F41B 11/642; F41B 11/89; F41B 11/00; F41B 33/00; F41B 7/08; F41A 33/00; F41A 33/06
See application file for complete search history.

(56) References Cited

U.S. PATENT DOCUMENTS 2,708,319 A * 5/1955 Tratsch ..... F41A 33/06 434/18
4,829,877 A * 5/1989 Zerega ..... F41A 21/26 434/18
7,191,775 B1 * 3/2007 Lo ..... F41A 11/00 124/65
8,449,346 B2 5/2013 Lee
8,746,226 B2 * 6/2014 Lee ..... F41A 33/06 124/56
9,291,420 B1 * 3/2016 Jensen ..... F41G 3/26
2008/0155875 A1 * 7/2008 Iwasawa ..... F41B 11/89 42/54
2009/0101130 A1 * 4/2009 Hu ..... F41A 33/06 124/80
2011/0041825 A1 * 2/2011 Hu ..... F41A 33/06 124/71
2012/0240912 A1 * 9/2012 Hu ..... F41A 33/06 124/80

FOREIGN PATENT DOCUMENTS

EP 2113736 A1 11/2009
JP 2014149132 A * 8/2014
TW M410209 U 8/2011
TW M436160 U 8/2012
TW M451523 U 4/2013

* cited by examiner

*Primary Examiner* — Christopher Harmon

(57) ABSTRACT

The invention relates to a pneumatic toy gun recoil device, which uses pneumatic means to substitute mechanical means like springs for cushioning and retracting effect, so as to resolve technical problems of conventional techniques. Said resolved technical problems, such as, the springs serve as mechanical means are easy wearing or elastic fatigue, and are also difficult to assemble and mount. Furthermore, the invention not only provides recoil simulating the recoil of a gun firing gunpowder propelled projectiles, but also has advantages of good quality control and long life for toy gun products.

11 Claims, 5 Drawing Sheets

PNEUMATIC TOY GUN RECOIL DEVICE

BACKGROUND OF THE INVENTION

Field of the Invention

The invention relative to a pneumatic toy gun recoil device, particularly, to a toy gun recoil device that applies pneumatic means to generate extension force and the retraction force.

Description of the Related Art

Toy gun is a widely loved entertaining product, many of people of all ages have been hobbyists thereof. As developed in the field of technology, to provide better entertainment, toy guns with recoil devices that simulates the recoil of real gun firing are provided, and thus enhance the authenticity and presence.

The traditional recoil generating devices, normally, implement pistons, springs, guide rod, weights and retraction springs and other components to fit inside chambers of toy gun hulls. As the traditional recoil generating devices use springs as recoil force generation and transmission elements, since springs would reduce its resilient force after a long term and frequent use that causes elastic fatigue, the effect of recoil of toy guns could be abated. Otherwise, said springs, as non constant-geometry components, may be not easy to be installed or fixed in product assembling process. Moreover, said springs, are not easy to be precisely positioned, which lead to a low recoil force transmission efficiency. Aforesaid problems are inadequacies of prior art.

With understanding aforesaid, the applicant of present invention is therefore trying to invent a pneumatic toy gun recoil device, to resolve the drawbacks of the prior art and improve the utility of the industry.

SUMMARY OF THE INVENTION

In order to overcome the drawbacks of prior art, one of the objectives of the invention is to provide a pneumatic toy gun recoil device.

To achieve aforesaid objective, the invention provides the pneumatic toy gun recoil device, which comprising: a gun body comprising a gun midpiece and a butt portion. The gun midpiece has a primary chamber formed therein and a piston groove is formed inside the primary chamber. The gun midpiece has a trigger element. The butt portion is correspondingly mounted on a rear side of the gun midpiece. The butt portion has a pneumatic hammer chamber formed therein, a front end of the pneumatic hammer chamber has a through hole. The through hole communicates with the primary chamber and corresponds to the piston groove. A rear end wall of the pneumatic hammer chamber has a first air hole. The first air hole communicates with the pneumatic hammer chamber. A side wall of the pneumatic hammer chamber has at least one second air hole. The second air hole communicates with the pneumatic hammer chamber from outside. A piston power module comprises a piston element and a driving device. The piston element comprises a piston body, a linking element, a retracting unit, a pneumatic piston and a resilient element. The piston body is correspondingly mounted inside the piston groove, and is able to move longitudinally in the piston groove. A side wall of the piston body has a rack structure. A front end of the linking element abuts against the piston body, and a rear end of the linking element extends through the through hole and into the pneumatic hammer chamber. The retracting unit is correspondingly mounted in the primary chamber, and is capable of providing a retraction force toward a front side as the piston body moves toward a rear side. The pneumatic piston is correspondingly mounted on a rear end of the linking element and is movable in the pneumatic hammer chamber, and is able to block the air flow in the pneumatic hammer chamber and therefore forms an airtight seal. The pneumatic piston is located at a front side of the second air hole. The resilient element is correspondingly mounted on the pneumatic piston and a front end wall of the pneumatic hammer chamber, and can provide the pneumatic piston an elastic retraction force toward a front side when the pneumatic piston moves backward. The driving device is correspondingly mounted on the gun midpiece and engages with the rack structure, and is driven by the trigger element when the trigger element is manipulated. Such that the driving device drives the rack structure to move the piston body backward, and as well to move the pneumatic piston backward across the second air hole. The pneumatic hammer is correspondingly mounted in the pneumatic hammer chamber, located at a rear side of the second air hole, is movably mounted in the pneumatic hammer chamber, and is able to block the air flow in the pneumatic hammer chamber and therefore forms an airtight seal, thereby defines an air tight space between the pneumatic hammer and the pneumatic piston.

The primary chamber is a longitudinally configured elongate space. The piston groove is tubular structured with a closed front end and an opened rear end. The pneumatic hammer chamber is longitudinally mounted within the butt portion.

A rear section of the piston body extends through the piston groove. The linking element is a long rod. The retracting unit is a spring mounted around the linking element.

A wall of the pneumatic piston has at least one first sealing ring. The first sealing ring abuts against the wall of the pneumatic hammer chamber to block the air flow and therefore forms an airtight seal. The driving device is a driving motor and a drive gear set. A wall of the pneumatic hammer has at least one second sealing ring. The second sealing ring abuts against the wall of the pneumatic hammer chamber to block the air flow and therefore forms an airtight seal.

The pneumatic toy gun recoil device of the invention designs and provides a pneumatic means that replace mechanical cushion and retraction means like springs, so as to resolve the technical problems of prior art that implement those mechanical means like springs. The springs, for example, are made of materials that are wearable and elastic fatigue, and are difficult for installation and position. Thus, the invention has advantages like providing better quality controllability and allowing a long life for products.

A more complete appreciation of the invention, and many of the attendant advantages thereof, will be readily apparent as the same become better understood by reference to the following detailed description when considered in conjunction with the accompanying drawings.

DETAILED DESCRIPTION OF THE INVENTION

Figure 1:
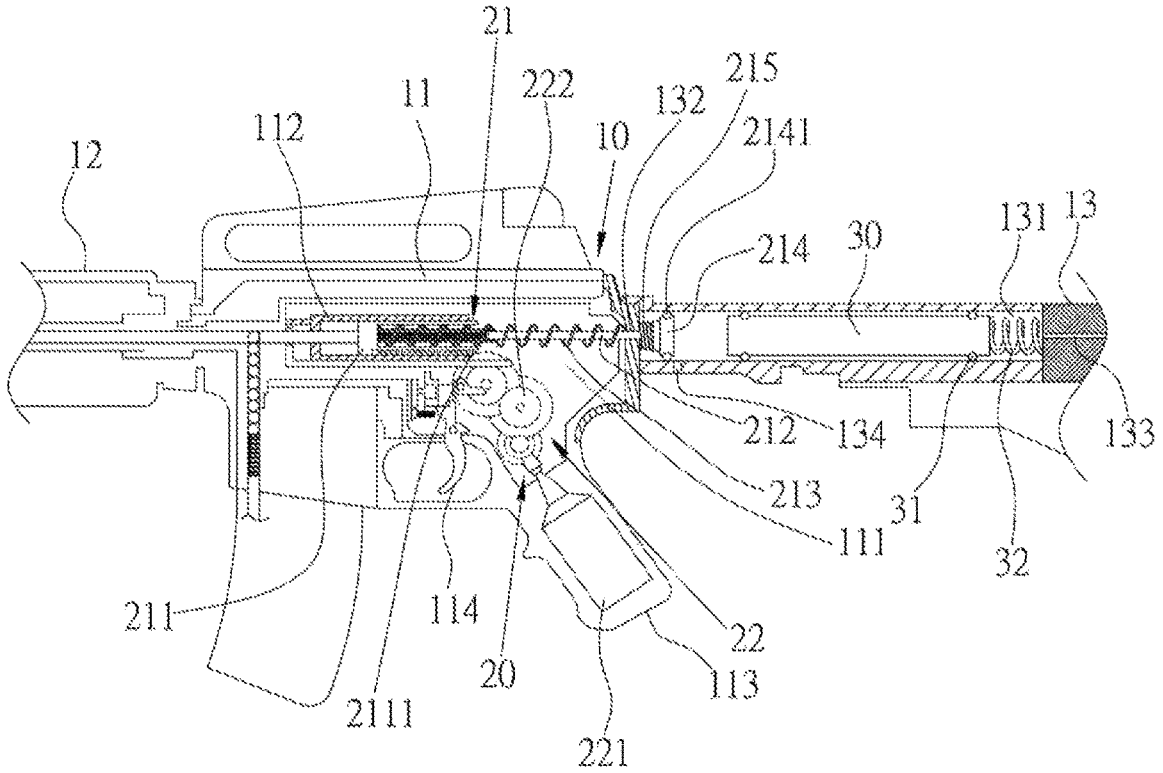
FIG. 1 is a partial cross-sectional side view of the pneumatic toy gun recoil device of the invention.

For the examiner's better understood of features, contents, advantages and achieved effect of present invention, detailed description of embodiments that considered in conjunction with the accompanying drawings is as illustrated as following. Various exemplary embodiments of the invention will be described more fully hereinafter with reference to the accompanying drawings, which are for purpose of illustration and clarification. In the drawings, the sizes and relative layouts should not be limited in the sizes and configurations of the drawings and thus limit the claims of the invention.

The advantages, features and means of the invention will be readily understood by following detailed description with reference to the accompanying drawings. The invention is achieved in various styles, and should not be limited as embodiments that described herein. In the contrary, to these who skilled in the art, the embodiments are deem to illustrate the scope of the invention in a clear, full and concise way, and the scope of the invention is defined by claims thereof.

Unless otherwise defined, all terms (including technical and scientific terms) used herein have the same meaning as commonly understood by one of ordinary skill in the art to which this invention pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
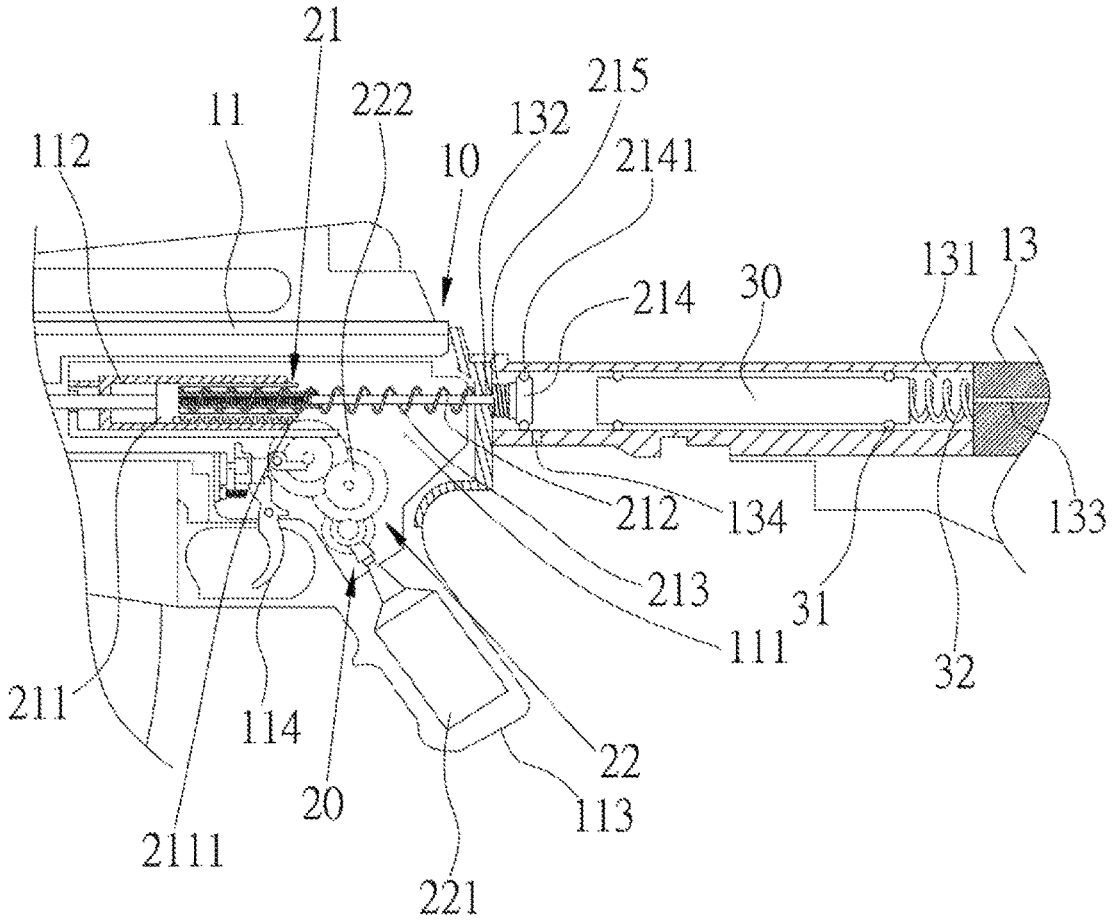
FIG. 2 is a partial cross-sectional side view of the pneumatic toy gun recoil device of the invention.

With reference to FIGS. 1 and 2, the invention provides a pneumatic toy gun recoil device. In present preferred embodiment, the pneumatic toy gun recoil device comprises a gun body (10), a piston power module (20) and a pneumatic hammer (30).

The gun body (10) is shape as a toy gun, which comprise a gun midpiece (11), a barrel portion (12) and a butt portion (13).

The gun midpiece (11) has a primary chamber (111) formed therein. The primary chamber (111) is a longitudinally configured elongate space, and a front end of the primary chamber (111) has a piston groove (112). The piston groove (112) is tubular structured with a closed front end and an opened rear end. Furthermore, the gun midpiece (11) has a handle portion (113) and a trigger element (114). The barrel portion (12) is correspondingly mounted on a front side of the gun midpiece (11).

The butt portion (13) is correspondingly mounted on a rear side of the gun midpiece (11), and the butt portion (13) has a longitudinal pneumatic hammer chamber (131) formed therein. A front end of the pneumatic hammer chamber (131) has a through hole (132) communicating with the primary chamber (111) and aligning to the piston groove (112). A rear end wall of the pneumatic hammer chamber (131) further has a first air hole (133) communicating with the pneumatic hammer chamber (131) from outside and allowing air flows in and out. Besides, a side wall of the pneumatic hammer chamber (131) has at least one second air hole (134) communicating with the pneumatic hammer chamber (131) from outside and allowing air flows in and out.

Said piston power module (20) comprising a piston element (21) and a driving device (22).

The piston element (21) comprises a piston body (211), a linking element (212), a retracting unit (213), a pneumatic piston (214) and a resilient element (215).

The piston body (211) is correspondingly mounted inside the piston groove (112), and is able to move longitudinally in the piston groove (112). A rear section of the piston body (211) extends through the piston groove (112), and a side wall of the piston body (211) has a rack structure (2111) mounted thereon.

A front end of the linking element (212) abuts against the piston body (211), and a rear end of the linking element (212) extends through the through hole (132) and into the pneumatic hammer chamber (131). The linking element (212) is a long rod.

The retracting unit (213) is correspondingly mounted in the primary chamber (111), and is capable of providing a retraction force toward a front side as the piston body (211) moves toward a rear side. The retracting unit (213) is a spring mounted around the linking element (212).

The pneumatic piston (214) is correspondingly mounted on a rear end of the linking element (212), and is movable in the pneumatic hammer chamber (131), and is able to block the air flow in the pneumatic hammer chamber (131) and therefore forms an airtight seal. A wall of the pneumatic piston (214) has a first sealing ring (2141). The first sealing ring (2141) abuts against the wall of the pneumatic hammer chamber (131) and forms an air tight seal. The pneumatic piston (214) is located at a front side of the second air hole (134).

The resilient element (215) is correspondingly mounted on the pneumatic piston (214) and the front end wall of the pneumatic hammer chamber (131). When the pneumatic piston (214) move backward, an elastic retraction force toward a front side is provided to the pneumatic piston (214). The resilient element (215) is a spring.

The driving device (22) is correspondingly mounted on the gun midpiece (11) and engages with the rack structure (2111), and is driven by the trigger element (114) when the trigger element (114) is manipulated. When the rack structure (2111) and the piston body (211) is driven to move backward, the pneumatic piston (214) is moved backward across the second air hole (134). After the move, the piston body (211) is driven by the retraction force of the retracting unit (213) to move back into an original position. The driving device (22) may include a driving motor (221) and a drive gear set (222).

Said pneumatic hammer (30) is correspondingly mounted in the pneumatic hammer chamber (131), located at a rear side of the second air hole (134), and is movable in the pneumatic hammer chamber (131), and is able to block the air flow in the pneumatic hammer chamber (131) and therefore forms an airtight seal. By this way to define an air tight space between the pneumatic hammer (30) and the pneumatic piston (214). A wall of the pneumatic hammer (30) has at least one second sealing ring (31). The second sealing ring (31) abuts against a wall of the pneumatic hammer chamber (131) and forms an air tight seal. An auxiliary ejector (32) is mounted between a rear end of the pneumatic hammer (30) and a rear side wall of the pneumatic hammer chamber (131). The auxiliary ejector (32) is capable of providing a retraction force toward a front side for the pneumatic hammer (30) as the pneumatic hammer (30) moves toward a rear side. The auxiliary ejector (32) is a spring.

Figure 3:
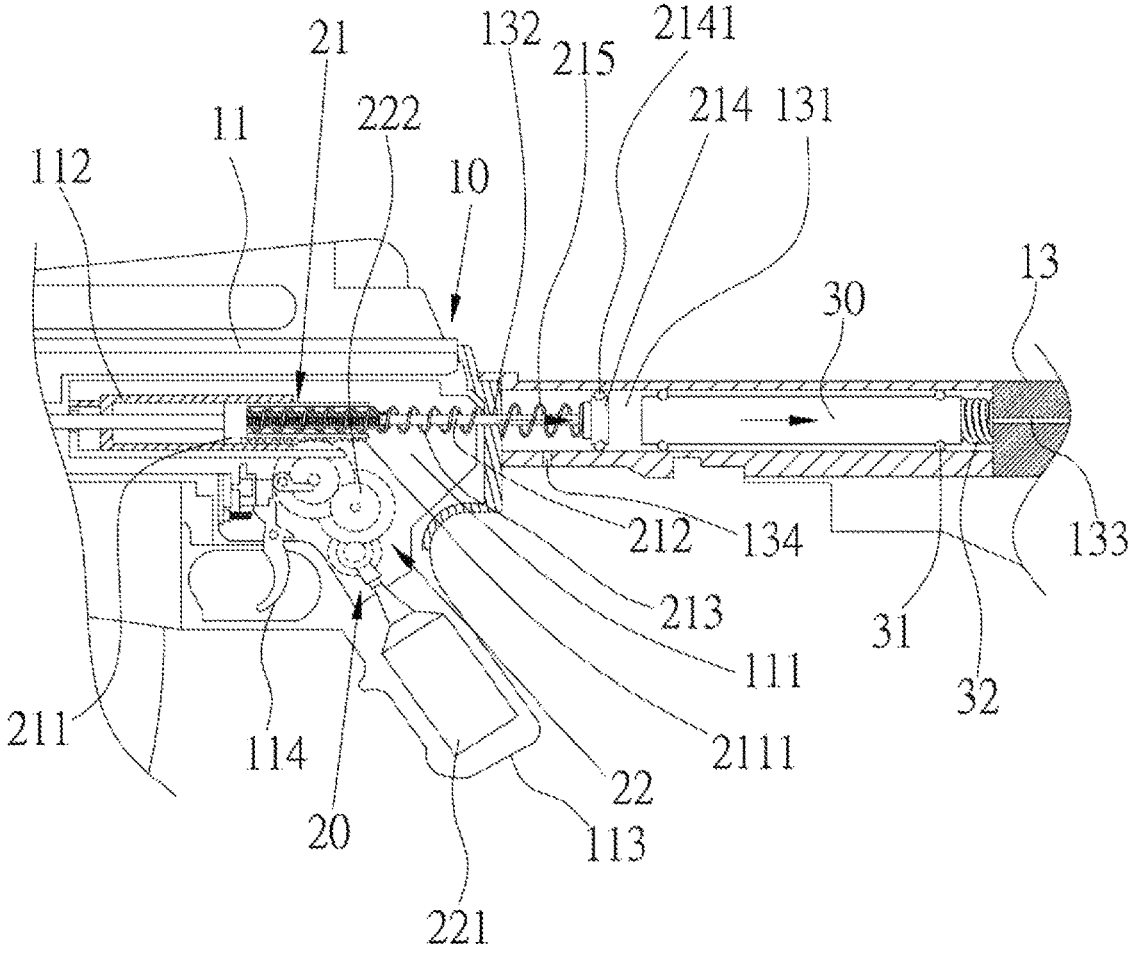
FIG. 3 is a movement partial cross-sectional side view of the pneumatic toy gun recoil device of the invention.

With reference to FIG. 3, in such manner, when the pneumatic piston (214) move backward and across the second air hole (134), air pressure is then generated to push the pneumatic hammer (30) to move backward and hit a rear side wall of the pneumatic hammer chamber (131). Thereby, the recoil effect is provided as the trigger element (114) manipulated.

Figure 4:
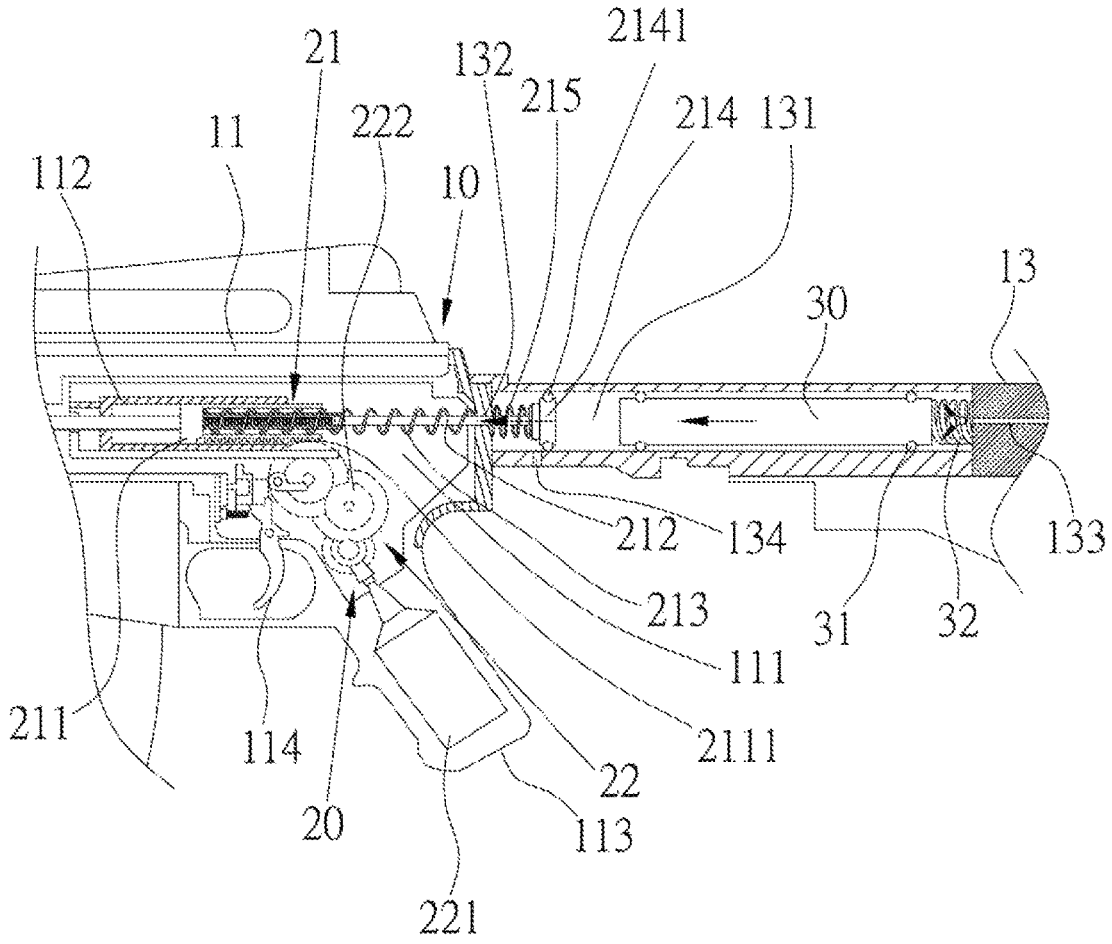
FIG. 4 is a movement partial cross-sectional side view of the pneumatic toy gun recoil device of the invention.

With further reference to FIG. 4, when the piston body (211) driven by the retraction force of the retracting unit (213) to move toward a front side, and the resilient element (215) drives the pneumatic piston (214) to move forward, due to a pressure reduce in the air tight space, the pneumatic hammer (30) is driven by the air pressure in the rear side to move toward a front side, so as to complete a position reset movement.

Figure 5:
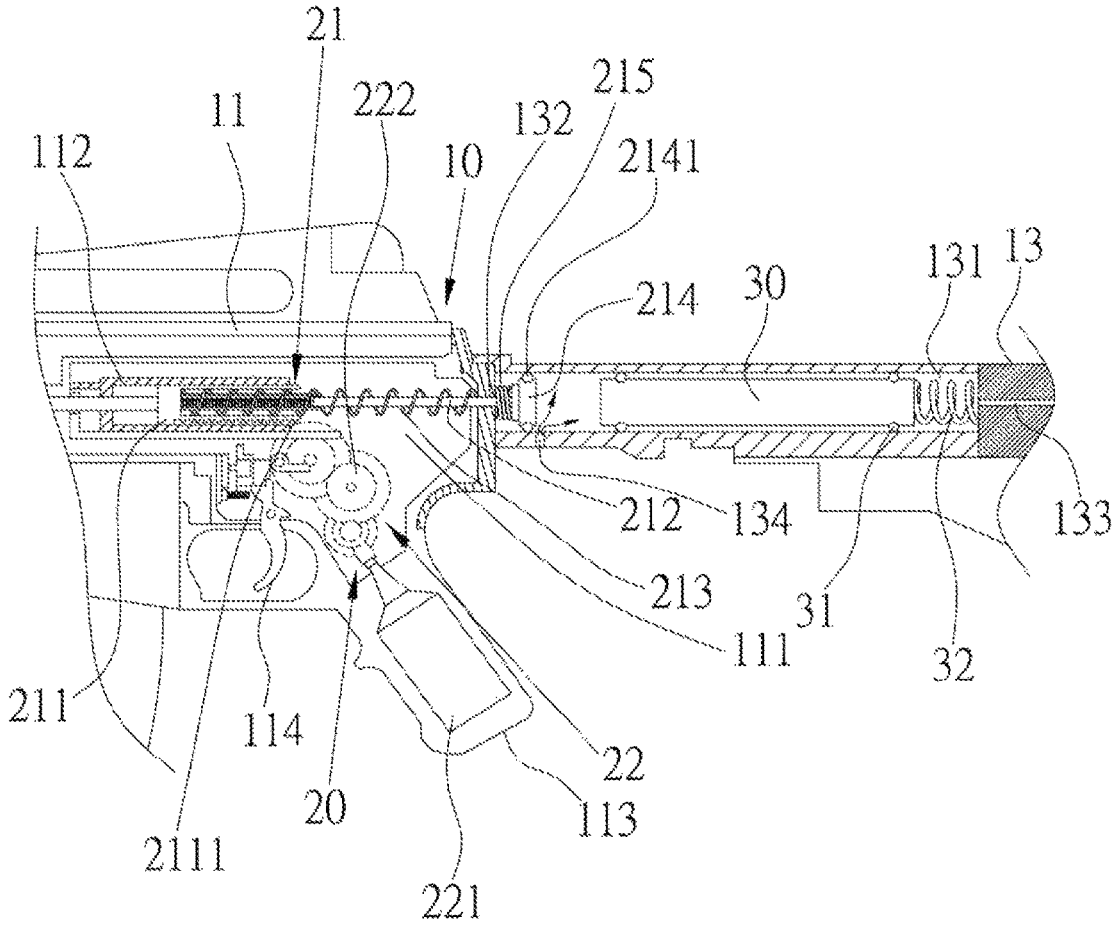
FIG. 5 is a movement partial cross-sectional side view of the pneumatic toy gun recoil device of the invention.

With further reference to FIG. 5, when the piston body (211) driven by the retraction force of the retracting unit (213) to move toward a front side, and the resilient element (215) drives the pneumatic piston (214) to move forward to make the pneumatic piston (214) across the second air hole (134), due to air flow into the second air hole (134) and balancing of the pressure between the front side and the rear side of the pneumatic hammer (30), the pneumatic hammer (30) holds in position, so as to complete a toy gun shooting cycle.

By designed features of the pneumatic toy gun recoil device of the invention, a pneumatic means is provided to replace traditional cushion and retraction technology implementing mechanical means like springs, so as to resolve the technical problems in prior art that uses springs for cushion and retraction.

The springs, for example, are made of materials that are wearable and elastic fatigue, and are difficult for installation and position. Thus, the invention not only provides recoil simulating the recoil of a gun firing but also has advantages like providing better quality controllability and allowing a long life for products. Thus, the invention provides more benefits that the prior art does not provide.

Exemplary embodiments have been disclosed herein to describe the techniques and characteristics of the present invention are to be interpreted in a generic and descriptive sense for those who skilled in the art only and not for purpose of limitation. Accordingly, numerous modifications and variations could be made by those skilled in the art without departing from the scope and spirit of the invention set forth in the claims.

Summing up the above, through the invention is different from the prior art, and indeed has been reached enhanced effect, and is also not easily thought by those who skilled in the art, the invention shall have novelty, non-obviousness and utility. The applicant hereby file this patent application, a rapid permit of patent is respectively required.

What is claimed is:

1. A pneumatic toy gun recoil device, comprising:

a gun body comprising a gun midpiece having a primary chamber formed therein, a piston groove formed in the primary chamber, and a trigger element; and a butt portion being correspondingly mounted on a rear side of the gun midpiece, and having a pneumatic hammer chamber formed therein;

a through hole formed in a front end of the pneumatic hammer chamber and communicating with the primary chamber and aligning to the piston groove;

a first air hole formed in a rear end wall in the pneumatic hammer chamber and communicating with the pneumatic hammer chamber from outside; and at least one second air hole formed in a side wall of the pneumatic hammer chamber and communicating with the pneumatic hammer chamber from outside;

a piston power module comprising a piston element having a piston body being correspondingly mounted inside the piston groove, and being able to slide longitudinally in the piston groove, and having a rack structure on a side wall of the piston body;

a linking element having a front end abutting against the piston body and a rear end extending through the through hole and into the pneumatic hammer chamber;

a retracting unit being correspondingly mounted in the primary chamber, and providing a retraction force toward a front side when the piston body moves backward;

a pneumatic piston being correspondingly mounted on a rear end of the linking element, and being able to move in the pneumatic hammer chamber, and being able to block the air flow in the pneumatic hammer chamber and therefore form an airtight seal, the pneumatic piston being located at a front side of the second air hole; and a resilient element being correspondingly mounted on the pneumatic piston and a front end wall of the pneumatic hammer chamber, and providing the pneumatic piston an elastic retraction force toward a front side when the pneumatic piston moves backward; and a driving device being correspondingly mounted on the gun midpiece, engaging with the rack structure, and being driven by the trigger element when the trigger element is manipulated, when the rack structure and the piston body moves backward, the pneumatic piston is driven across the second air hole; and a pneumatic hammer being correspondingly mounted in the pneumatic hammer chamber, located at a rear side of the second air hole, and being able to block the air flow in the pneumatic hammer chamber and therefore form an airtight seal so as to define an air tight space between the pneumatic hammer and the pneumatic piston.

2. The pneumatic toy gun recoil device as claimed in claim 1, wherein the primary chamber is a longitudinally configured elongate space.

3. The pneumatic toy gun recoil device as claimed in claim 1, wherein the piston groove is a tubular structure with a closed front end and an opened rear end.

4. The pneumatic toy gun recoil device as claimed in claim 1, wherein the pneumatic hammer chamber is longitudinal mounted in the butt portion.

5. The pneumatic toy gun recoil device as claimed in claim 1, wherein a rear section of the piston body extends through the piston groove.

6. The pneumatic toy gun recoil device as claimed in claim 1, wherein the linking element is a long rod.

7. The pneumatic toy gun recoil device as claimed in claim 1, wherein the retracting unit is a spring mounted around the linking element.

8. The pneumatic toy gun recoil device as claimed in claim 1, wherein a wall of the pneumatic piston has at least one first sealing ring abutting against a wall of the pneumatic hammer chamber to block the air flow and therefore form an airtight seal.

9. The pneumatic toy gun recoil device as claimed in claim 1, wherein the driving device includes a driving motor and a drive gear set.

10. The pneumatic toy gun recoil device as claimed in claim 1, wherein a wall of the pneumatic hammer has at least one second sealing ring abutting against a wall of the pneumatic hammer chamber to block the air flow and therefore form an airtight seal.

11. The pneumatic toy gun recoil device as claimed in claim 1, wherein an auxiliary ejector is mounted between a rear end of the pneumatic hammer and a rear side wall of the pneumatic hammer chamber.

* * * * *